US009276341B2

(12) United States Patent
Naito

(10) Patent No.: US 9,276,341 B2
(45) Date of Patent: Mar. 1, 2016

(54) CONNECTOR AND CONNECTOR ASSEMBLY

(71) Applicant: JAPAN AVIATION ELECTRONICS INDUSTRY, LIMITED, Shibuya-ku, Tokyo (JP)

(72) Inventor: Takeharu Naito, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/588,064

(22) Filed: Dec. 31, 2014

(65) Prior Publication Data

US 2015/0244091 A1 Aug. 27, 2015

(30) Foreign Application Priority Data

Feb. 26, 2014 (JP) ..... 2014-035238

(51) Int. Cl.

| | |
|---|---|
| ***H01R 13/64*** | (2006.01) |
| ***H01R 12/77*** | (2011.01) |
| *H01R 12/70* | (2011.01) |
| *H01R 12/79* | (2011.01) |

(52) U.S. Cl.

CPC ..... *H01R 12/772* (2013.01); *H01R 12/7052* (2013.01); *H01R 12/79* (2013.01)

(58) Field of Classification Search

CPC ..... H01R 12/7005; H01R 12/721; H01R 13/639; H01R 13/6275; H01R 12/716; H01R 12/714; H01R 12/774

USPC ..... 439/327–328, 493

See application file for complete search history.

(56) References Cited

U.S. PATENT DOCUMENTS

| | | | | |
|---|---|---|---|---|
| 6,960,094 | B2 * | 11/2005 | Tomonari | H01R 12/79 439/329 |
| 6,969,274 | B2 | 11/2005 | Kudo et al. | |
| 7,473,100 | B2 * | 1/2009 | Moritake | H01R 12/592 439/329 |
| 8,292,648 | B2 * | 10/2012 | Kiryu | H01R 13/6271 439/328 |

FOREIGN PATENT DOCUMENTS

| | | | |
|---|---|---|---|
| JP | 62186379 | U | 11/1987 |
| JP | 07153531 | A | 6/1995 |
| JP | 4030120 | B2 | 1/2008 |
| JP | 2012252912 | A | 12/2012 |

* cited by examiner

*Primary Examiner* — Xuong Chung Trans
(74) *Attorney, Agent, or Firm* — Holtz, Holtz & Volek PC

(57) ABSTRACT

A connector is connectable to an object. The object includes a regulated portion, a guided portion and a received portion. The connector includes a housing and a regulating member. The housing has a guide portion and a receive portion which opens forward. The regulating member has a spring portion and a regulating portion. The regulating portion is supported by the spring portion and is vertically movable. When the guided portion is moved rearward along the guide portion under a state where the regulating portion is pressed by the object to be moved downward from an initial position, the receive portion receives the received portion, and the connector is connected to the object. Under a connected state where the connector is connected to the object, the regulating portion returns to the initial position to be located forward of the regulated portion to regulate a forward movement of the regulated portion.

10 Claims, 10 Drawing Sheets

CONNECTOR AND CONNECTOR ASSEMBLY

CROSS REFERENCE TO RELATED APPLICATIONS

An applicant claims priority under 35 U.S.C. §119 of Japanese Patent Application No. JP2014-035238 filed Feb. 26, 2014.

BACKGROUND OF THE INVENTION

This invention relates to a connector connectable to an object such as a flexible printed circuit (FPC).

For example, this type of connector is disclosed in JP-B 4030120 (Patent Document 1), the content of which is incorporated herein by reference.

As shown in FIGS. 18 and 19, the connector 900 disclosed in Patent Document 1 is connectable to a flexible board (object) 950. The flexible board 950 has two protruding portions 952 protruding sideward. Each of the protruding portions 952 is provided with wired patterns 954. The connector 900 includes a housing 910 and a plurality of contacts 920 held by the housing 910. The housing 910 is formed with two receiving grooves 912. The receiving grooves 912 are located at opposite sides of the connector 900, respectively, and open forward. Each of the contacts 920 has two contact portions 922 which vertically face each other. The contact portions 922 of the contact 920 are arranged within the receiving groove 912. When the flexible board 950 is pulled rearward under a state where the protruding portions 952 are located forward of the receiving grooves 912, respectively, the protruding portions 952 are received into the receiving grooves 912, respectively, so that each of the wired patterns 954 of the protruding portions 952 is brought into contact with the contact portions 922 of the corresponding contact 920.

When the connector 900 of Patent Document 1 is in a connected state where the connector 900 is connected to the object 950, the contact portions 922 of each of the contacts 920 vertically sandwich the protruding portion 952 of the object 950 with a predetermined spring force. The connected state of the connector 900 to the object 950 is maintained by this spring force. When the number of the contacts 920 is small, sufficient spring force cannot be obtained so that the connected state might be canceled, for example, by continuous vibration or impact. Moreover, it is difficult to check from outside whether the contact portion 922 of the connector 900 of Patent Document 1 is in contact with the wired pattern 954 or not. In other words, it is difficult to check whether the connector 900 and the object 950 are properly connected to each other or not.

SUMMARY OF THE INVENTION

It is therefore an object of the present invention to provide a connector which can more securely maintain a connected state to an object and which makes it possible to easily check if the connector is properly connected to the object.

One aspect of the present invention provides a connector connectable to an object. The object comprises a regulated portion, a guided portion extending along a front-rear direction and a front end portion located forward of the guided portion. The front end portion has a received portion protruding sideward beyond the guided portion. The received portion is formed with a contact terminal. The connector comprises a housing, a contact and a regulating member. The housing has a guide portion and a receive portion. The guide portion extends along the front-rear direction. The receive portion is located at a side of the guide portion and opens forward. The contact has a held portion and a contact portion. The held portion is held by the housing. The contact portion is located in the receive portion. The regulating member has a spring portion and a regulating portion. The regulating member is fixed to the housing. The regulating portion is supported by the spring portion and is vertically movable. When the guided portion is moved rearward along the guide portion under a state where the regulating portion is pressed by the object to be moved downward from an initial position, the connector is connected to the object. Under a connected state where the connector is connected to the object, the receive portion receives the received portion, and the contact portion is brought into contact with the contact terminal. Under the connected state, the regulating portion returns to the initial position and is located forward of the regulated portion to regulate a forward movement of the regulated portion.

Another aspect of the present invention provides a connector assembly comprising the aforementioned connector and a flexible printed circuit (FPC) which is one kind of the object. The regulated portion is a part of a front end of the front end portion.

According to the present invention, when the connector is in the connected state where the connector is connected to the object, the regulating portion is located forward of the regulated portion to regulate the forward movement of the regulated portion. Accordingly, the connected state can be maintained more securely. Moreover, since the regulating portion is supported by the spring portion, the regulating portion is pressed downward to be moved from the initial position upon the connection of the connector to the object while returning to the initial position under the mated state. Accordingly, when the connector is connected to the object, a click feeling can be obtained. This click feeling enables an operator to know that the connector is properly connected to the object.

An appreciation of the objectives of the present invention and a more complete understanding of its structure may be had by studying the following description of the preferred embodiment and by referring to the accompanying drawings.

Figure 1:
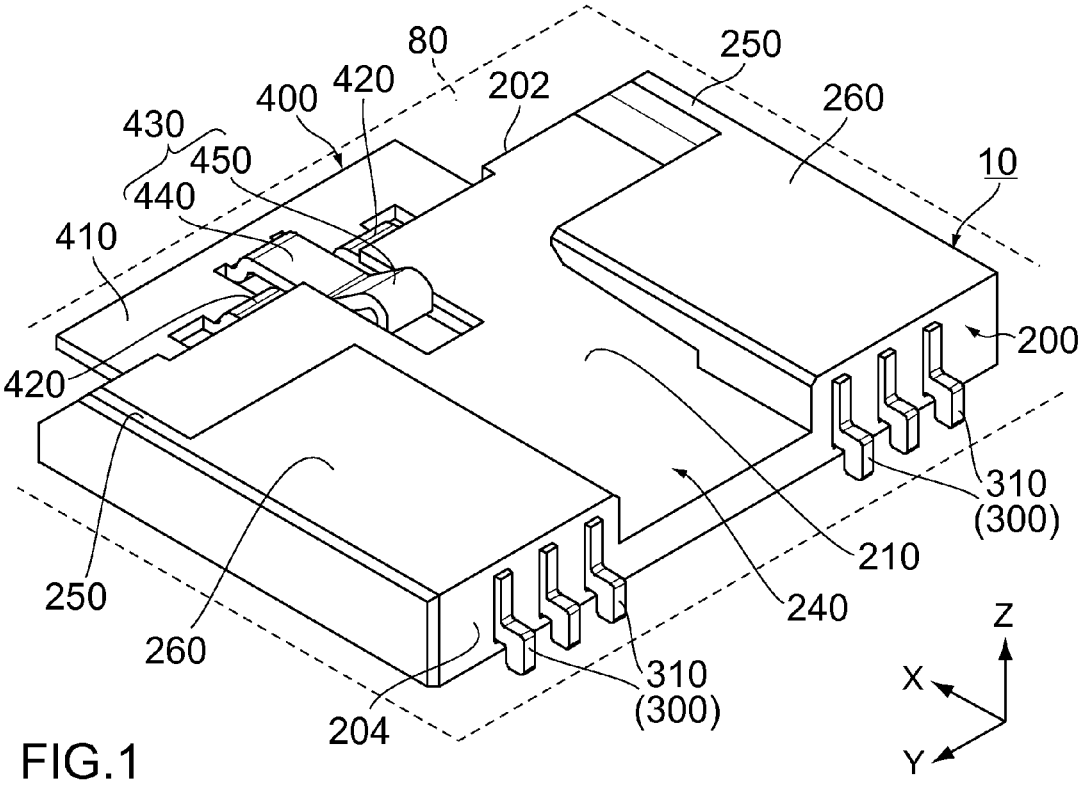
FIG. 1 is a perspective view showing a connector according to an embodiment of the present invention, wherein a part of a circuit board on which the connector is mounted is illustrated by dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 11:
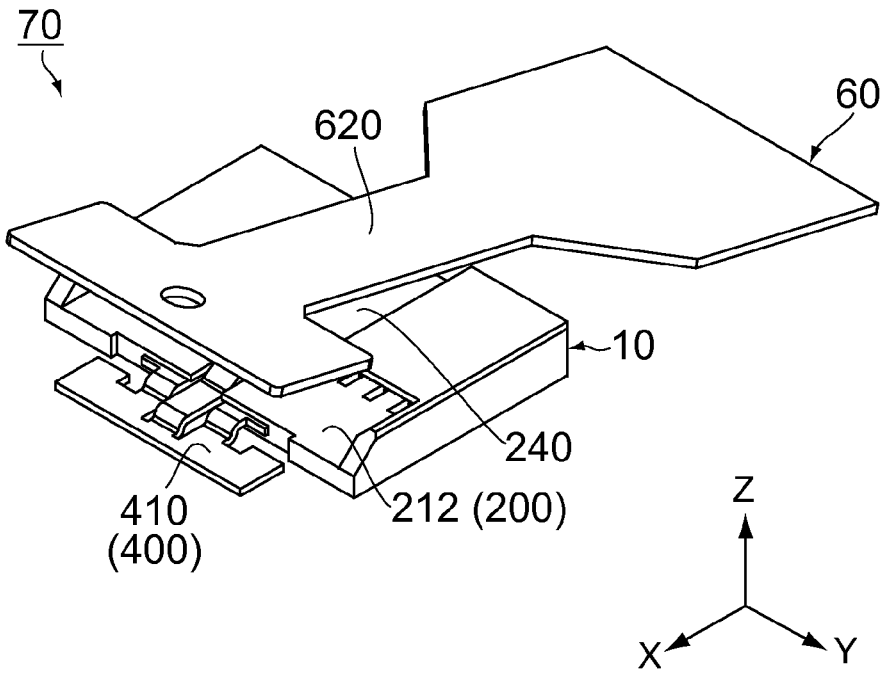
FIG. 11 is a perspective view showing a connector assembly including the connector of FIG. 1 and the FPC of FIG. 10, wherein the FPC is not yet placed on the connector.
Figure 12:
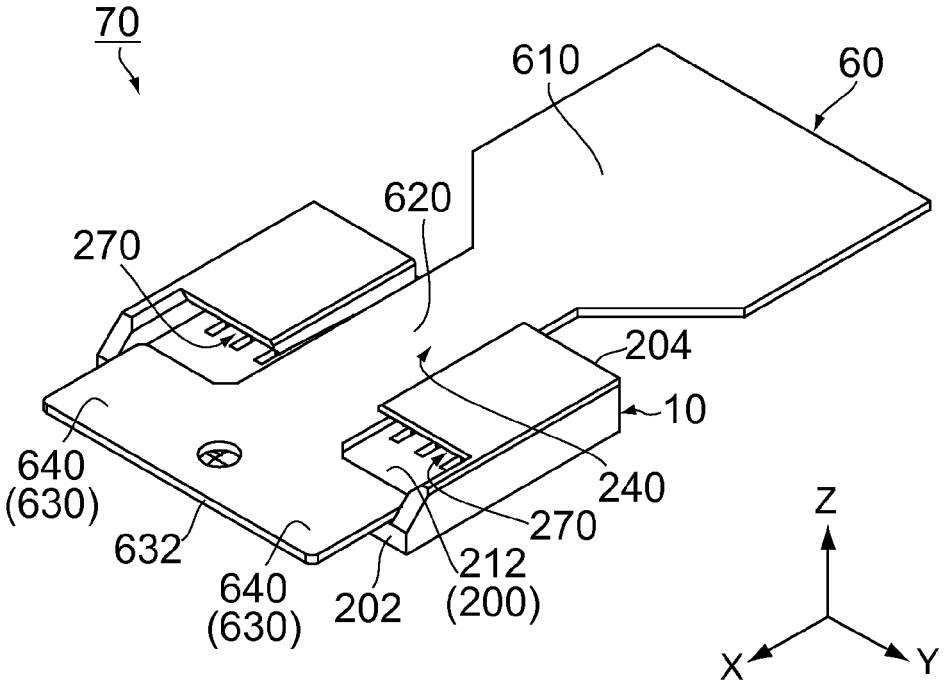
FIG. 12 is a perspective view showing the connector assembly of FIG. 11, wherein the FPC is placed on the connector while not yet connected to the connector.
Figure 14:
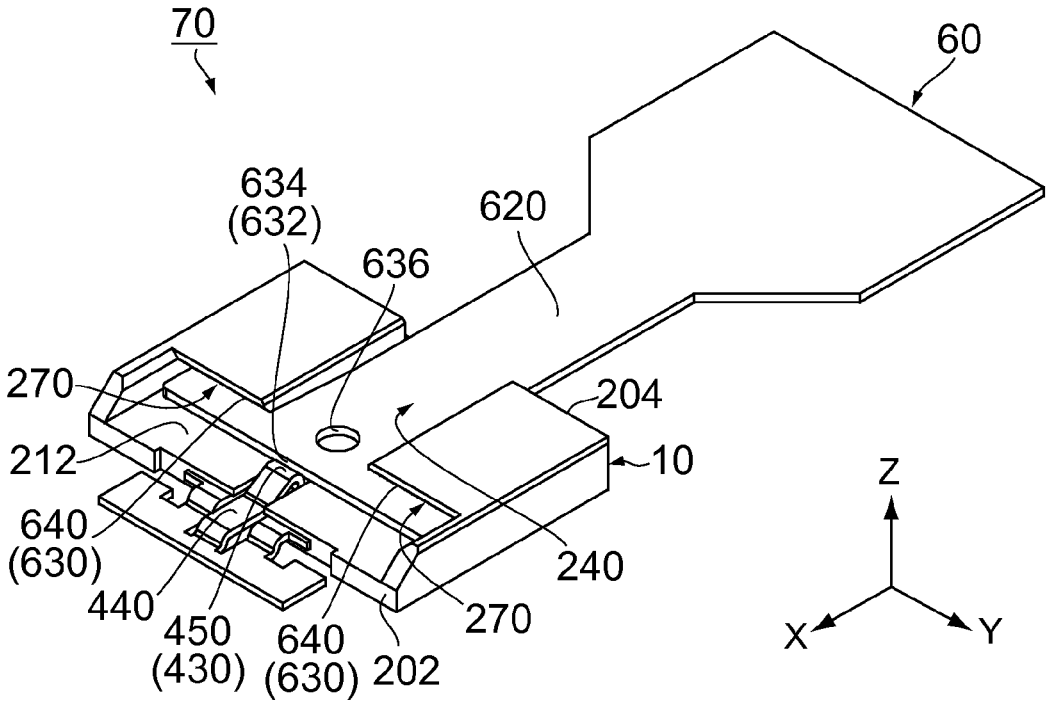
FIG. 14 is a perspective view showing the connector assembly of FIG. 11, wherein the FPC is connected to the connector.

As shown in FIGS. 11, 12 and 14, a connector assembly 70 according to the present embodiment comprises a connector 10 and an FPC (object) 60. The connector 10 is connectable to the FPC 60 and is maintainable a connected state (the state shown in FIG. 14) thereof with the FPC 60. In other words, in the present embodiment, the FPC 60 is the object that is to be connected to the connector 10. However, the object according to the present invention may be a member other than an FPC. For example, the present invention is also applicable to a connector which is connectable to a rigid circuit board (object).

Figure 10:
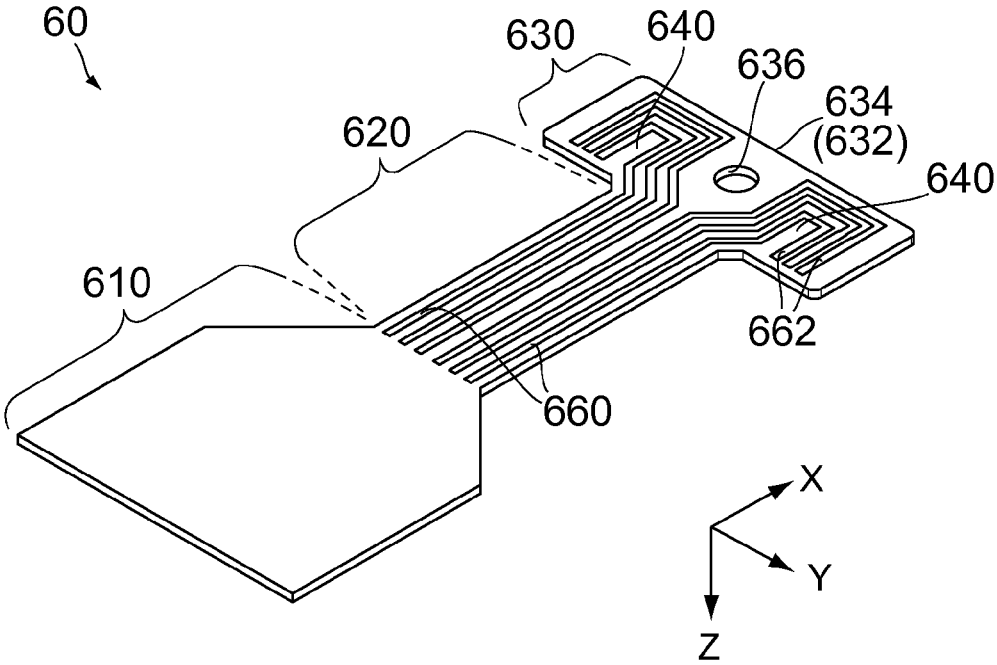
FIG. 10 is a lower perspective view showing an FPC connectable to the connector of FIG. 1.

As shown in FIGS. 10 and 12, the FPC 60 according to the present embodiment includes a base portion 610, a guided portion 620 and a front end portion 630. The guided portion 620 extends along a front-rear direction (X-direction) to couple the base portion 610 and the front end portion 630 with each other in the X-direction. The base portion 610 is located rearward, or toward the negative X-side, of the guided portion 620 while the front end portion 630 is located forward, or toward the positive X-side, of the guided portion 620. The front end portion 630 has a front end 632. The front end 632 according to the present embodiment is thin in an upper-lower direction (Z-direction) and extends long in a width direction (Y-direction).

As shown in FIG. 10, the FPC 60 includes a regulated portion 634, a release hole 636 and two received portions 640. The regulated portion 634 according to the present embodiment is a middle part of the front end 632 in the Y-direction. The release hole 636 is formed at the front end portion 630. In detail, the release hole 636 is located rearward of the regulated portion 634 and vertically pierces the front end portion 630 in the Z-direction. The received portions 640 are parts of the front end portion 630 and are located at opposite sides of the front end portion 630 in the Y-direction, respectively. The received portions 640 protrude sideward, or outward in the Y-direction, beyond the guided portion 620. In other words, the guided portion 620 and the front end portion 630 have a T-like shape as a whole.

The FPC 60 is provided with a plurality of conductive patterns 660. In the present embodiment, the number of the conductive patterns 660 is six. Moreover, in the present embodiment, the conductive patterns 660 are exposed only on a rear surface (negative Z-side surface) of the FPC 60. In detail, the conductive patterns 660 are exposed in the vicinity of a front end (positive X-side end) of the base portion 610 to extend to the received portions 640 via the guided portion 620. Each of the received portions 640 is formed of contact terminals 662 which are end portions of the conductive patterns 660. According to the present embodiment, each of the received portions 640 has three of the conductive patterns 660.

As shown in FIG. 1, the connector 10 according to the present embodiment comprises a housing 200 made of insulator, a plurality of contacts 300 each made of conductor and a holddown 400 made of metal. In the present embodiment, the number of the contacts 300 is six. The connector 10 according to the present embodiment is an on-board connector that is fixed to a circuit board 80 when used.

Figure 2:
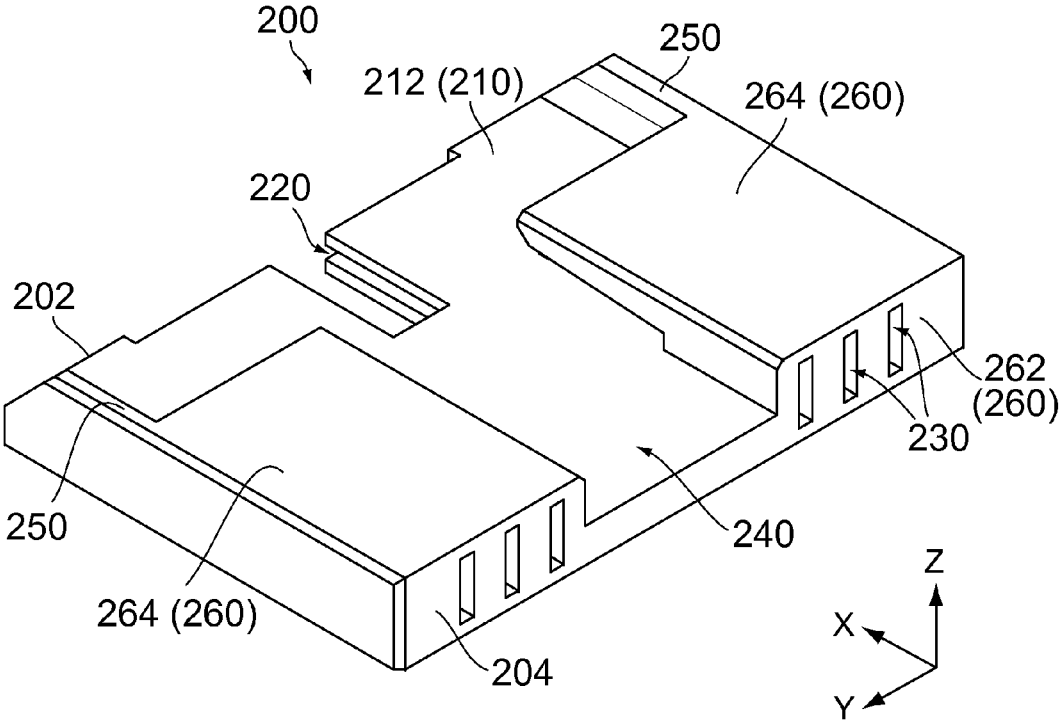
FIG. 2 is a perspective view showing a housing of the connector of FIG. 1.
Figure 3:
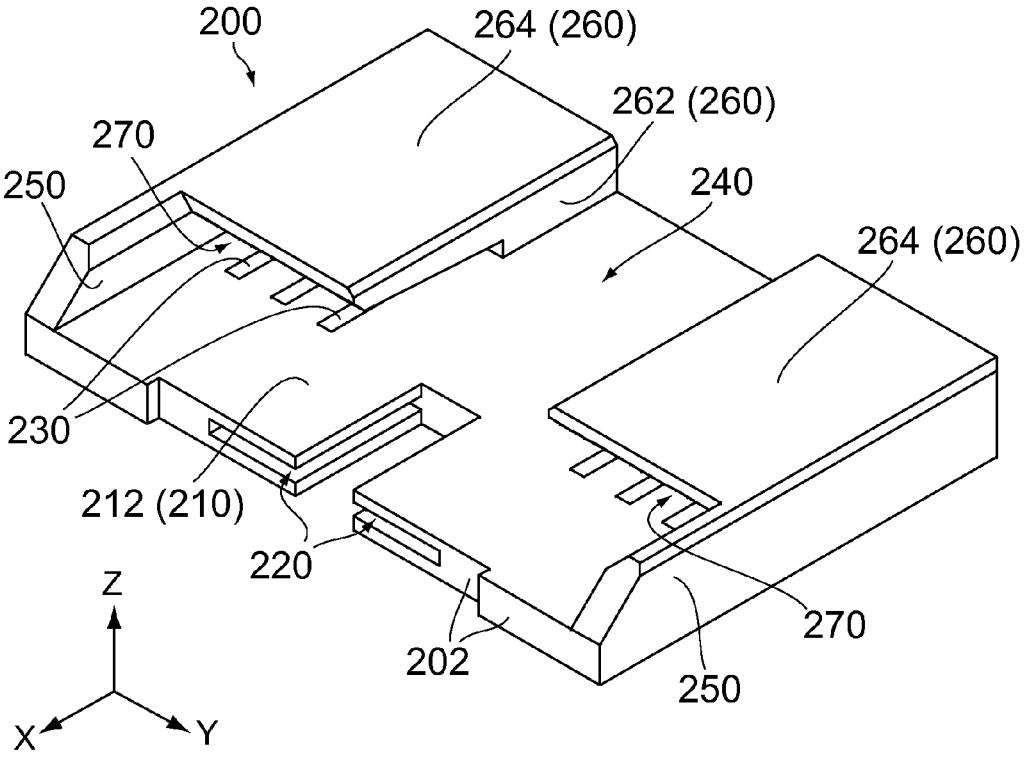
FIG. 3 is another perspective view showing the housing of FIG. 2.
Figure 4:
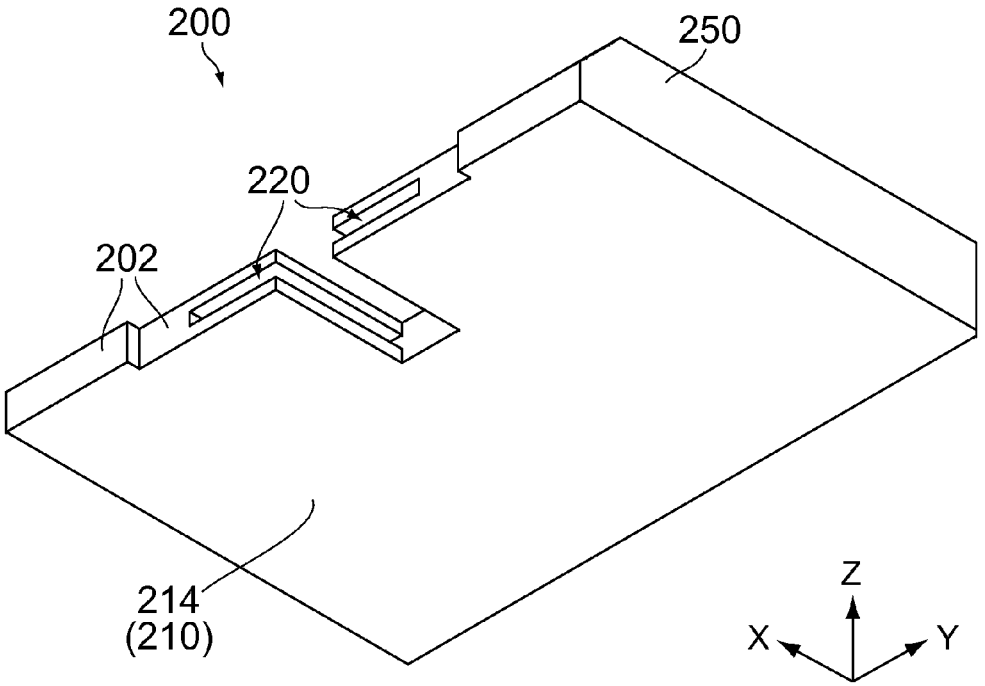
FIG. 4 is still another perspective view showing the housing of FIG. 2.

As shown in FIGS. 2 to 4, the housing 200 roughly has a flat plate-like shape which is thin in the Z-direction. The housing 200 has a front end 202 and a rear end 204 in the X-direction. Moreover, the housing 200 has a base portion 210, two side walls 250 and two covers 260.

The base portion 210 has an upper surface 212 and a lower surface 214 in the Z-direction. In the present embodiment, each of the upper surface 212 and the lower surface 214 is a horizontal plane in parallel to the X-direction and the Y-direction. The base portion 210 is formed with two fixing grooves 220. Each of the fixing grooves 220 is a recess recessed along the X-direction from the front end 202 of the housing 200 toward the rear end 204.

As shown in FIGS. 2 and 4, the side walls 250 are formed at opposite sides of the housing 200 in the Y-direction, respectively. The side walls 250 project upward (in the positive Z-direction) from the upper surface 212 of the base portion 210 while extending along the X-direction between the front end 202 and the rear end 204.

The covers 260 protrude inward in the Y-direction from the side walls 250, respectively. In detail, each of the covers 260 has a rear wall 262 and an upper wall 264. The rear wall 262 projects upward from the upper surface 212 while extending relatively long from the rear end 204 toward the front end 202. The upper wall 264 further extends from a front end of the rear wall 262 toward the front end 202 to cover a part of the upper surface 212 from above.

As shown in FIGS. 2, 3, 5 and 6, the housing 200 is formed with a plurality of accommodation ditches 230. In the present embodiment, the number of the accommodation ditches 230 is six. According to the present embodiment, each of the covers 260 is provided with the corresponding three accommodation ditches 230. Each of the accommodation ditches 230 extends from the rear end 204 toward the front end 202 so as to dig a lower part (negative Z-side part) of the rear wall 262 and an upper part (positive Z-side part) of the base portion 210. The accommodation ditch 230 has a front part (positive X-side part) and a rear part (negative X-side part), wherein the front part is a recess which is recessed downward (in the negative Z-direction) from the upper surface 212, and the rear part is a hole which communicates with the front part of the accommodation ditch 230 while piercing the rear wall 262 in the X-direction.

The housing 200 has a guide portion 240. The guide portion 240 according to the present embodiment is a space defined by the upper surface 212 and the covers 260. More specifically, the guide portion 240 is located between the two covers 260 in the Y-direction and is located on the upper surface 212 in the Z-direction. In other words, the guide portion 240 extends along the X-direction while opening upward, forward and rearward.

Figure 6:
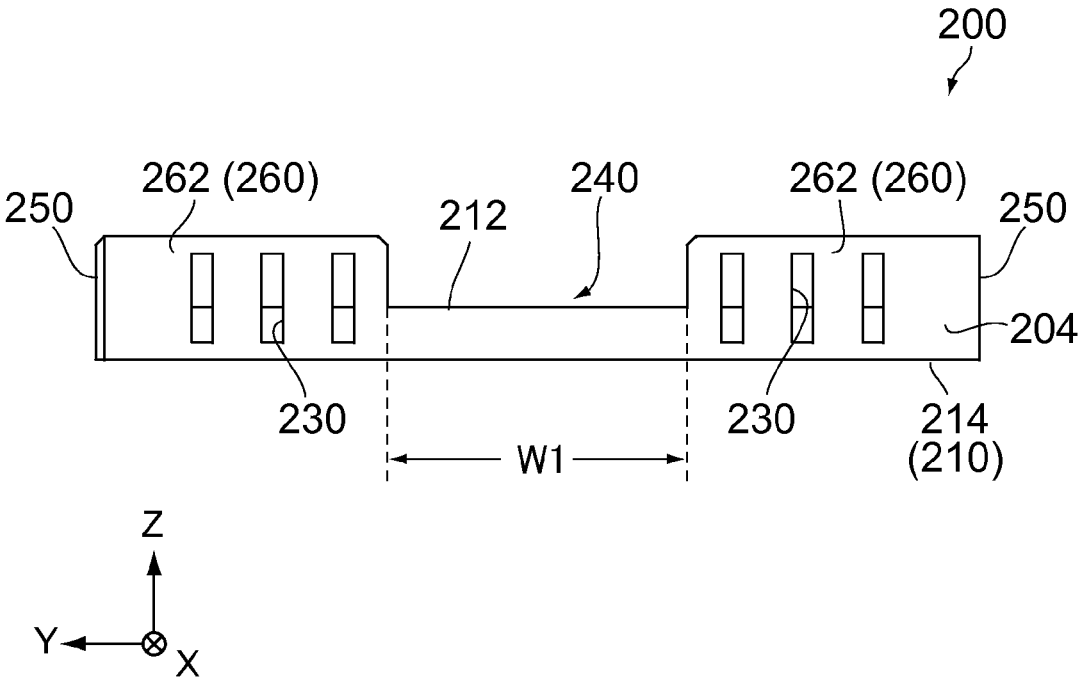
FIG. 6 is a rear view showing the housing of FIG. 2.
Figure 15:
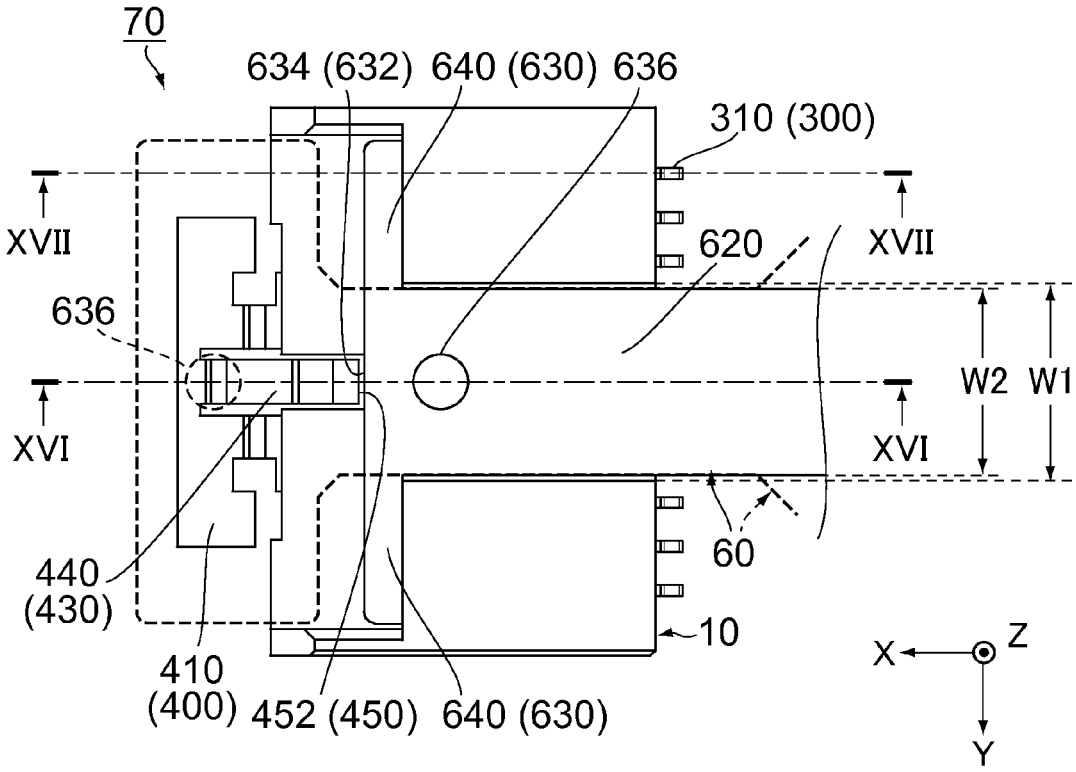
FIG. 15 is a top view showing the connector assembly of FIG. 14, wherein an outline of the FPC under a state shown in FIG. 12 is illustrated by dashed line.

Referring to FIGS. 6 and 15, the guide portion 240 has a width (a size in the Y-direction) W1 which is slightly larger than another width W2 of the guided portion 620 of The FPC 60, and the guide portion 240 has a length (a size in the X-direction) which is smaller than another length of the guided portion 620. In the present embodiment, the width W1 of the guide portion 240 is equal to a distance between the two rear walls 262 in the Y-direction.

Figure 5:
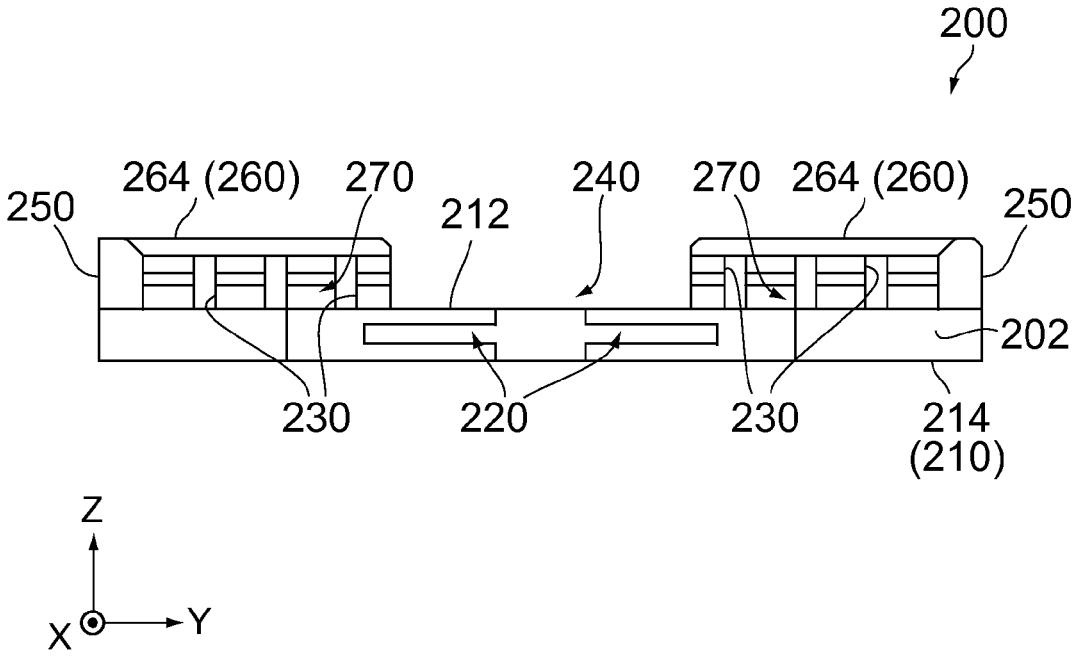
FIG. 5 is a front view showing the housing of FIG. 2.

As shown in FIGS. 3 and 5, the housing 200 has two receive portions 270. In other words, the connector 10 comprises the two receive portions 270. The receive portions 270 according to the present embodiment are provided under the covers 260, respectively. More specifically, each of the receive portions 270 is a space surrounded by the side wall 250, the rear wall 262 and the upper wall 264. Each of the receive portions 270 communicates with the corresponding accommodation ditches 230. Moreover, each of the receive portions 270 opens forward and inward in the Y-direction. The receive portions 270 are located beside, or outward of, the guide portion 240 in the Y-direction. In other words, the receive portions 270 are located at opposite sides of the housing 200 in the Y-direction, respectively, while putting the guide portion 240 therebetween.

Figure 7:
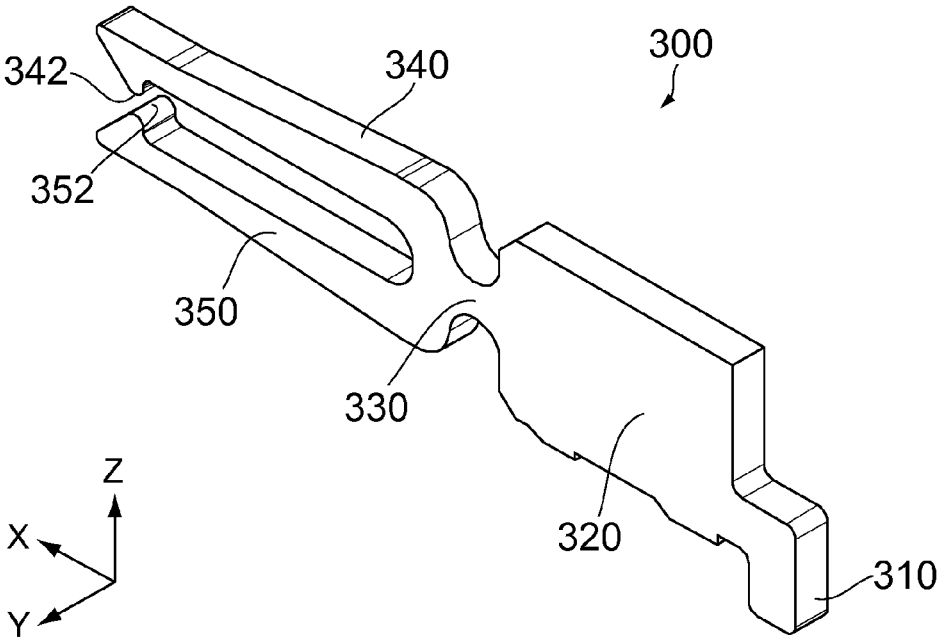
FIG. 7 is a perspective view showing a contact of the connector of FIG. 1.

As shown in FIG. 7, each of the contacts 300 according to the present embodiment has a fixed portion 310, a held portion 320, a coupling portion 330, a first spring portion 340, a first contact portion (contact portion) 342, a second spring portion 350 and a second contact portion (contact portion) 352. The fixed portion 310 extends downward. The held portion 320 extends forward from the fixed portion 310. The held portion 320 is formed with press-fit protrusions.

The coupling portion 330, the first spring portion 340 and the second spring portion 350 have a tuning-fork like shape as a whole. In detail, the coupling portion 330 extends forward from the held portion 320. The first spring portion 340 and the second spring portion 350 further extend forward from the coupling portion 330. The first spring portion 340 is located over the second spring portion 350. The first contact portion 342 is provided in the vicinity of an end of the first spring portion 340 while the second contact portion 352 is provided in the vicinity of an end of the second spring portion 350.

The first contact portion 342 projects downward, while the second contact portion 352 projects upward. Accordingly, the contact 300 is formed with a contact portion that is constituted of the first contact portion 342 and the second contact portion 352 which face each other vertically, or in the Z-direction. Each of the first spring portion 340 and the second spring portion 350 is resiliently deformable so that each of the first contact portion 342 and the second contact portion 352 is movable vertically, or in the Z-direction. A distance between the first contact portion 342 and the second contact portion 352 in the Z-direction is smaller than a thickness (a size in the Z-direction) of the FPC 60 (see FIG. 10).

Figure 17:
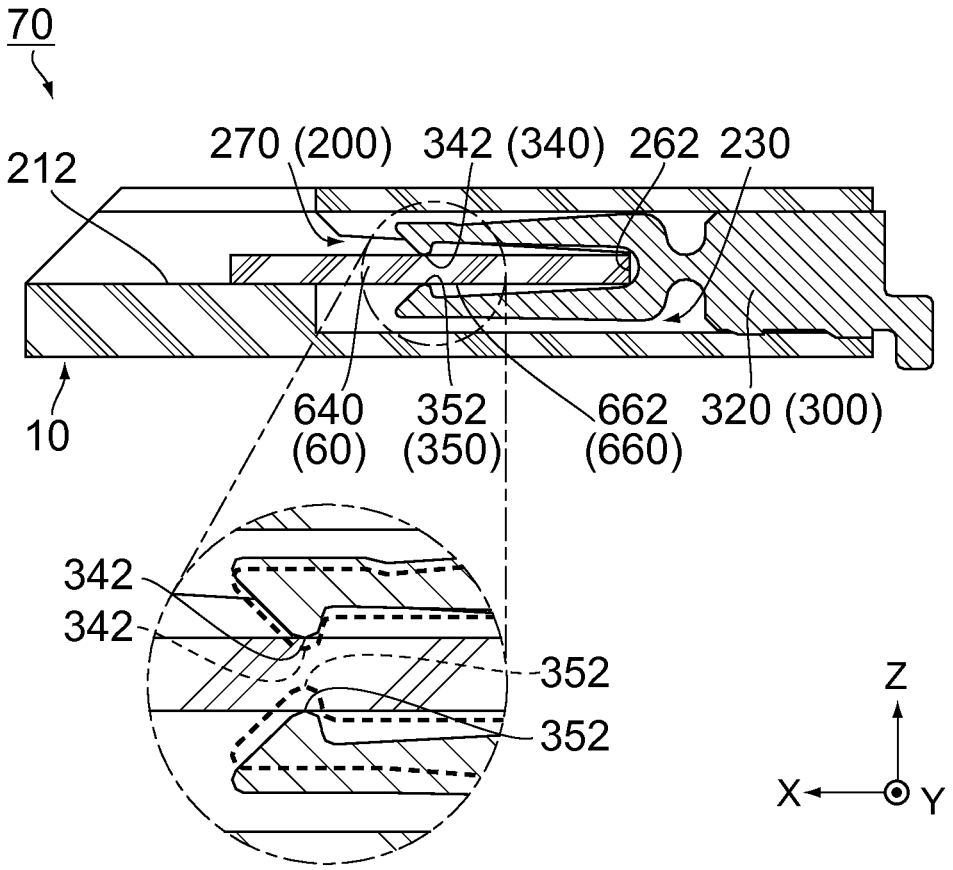
FIG. 17 is a cross-sectional view showing the connector assembly of FIG. 15, taken along line XVII-XVII, wherein the vicinity of contact portions of the contact (the part encircled by chain dotted line) is enlarged to be illustrated, and an outline of the contact prior to the connection of the connector to the FPC is illustrated by dashed line in the enlarged view.
Figure 18:
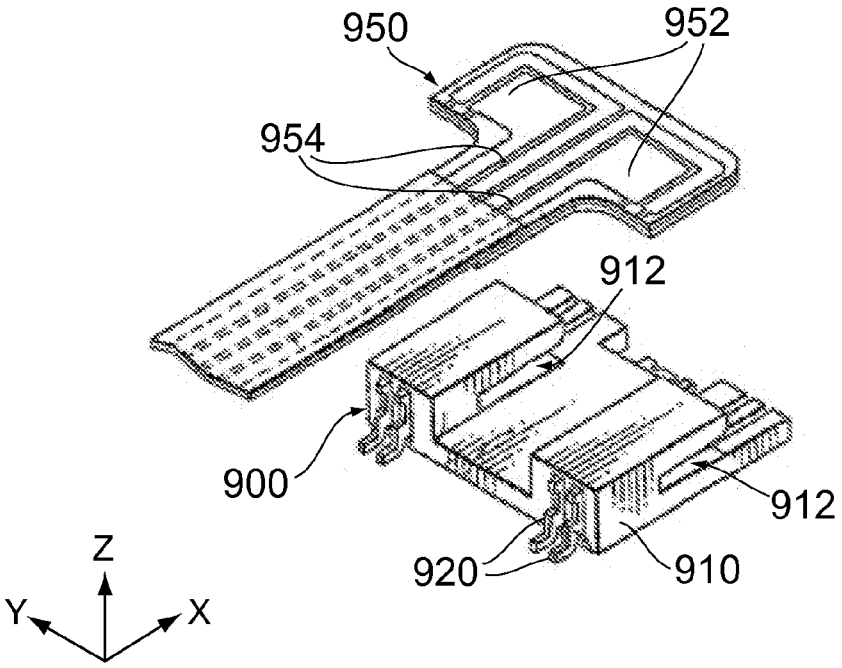
FIG.18 PRIOR ART
FIG. 18 is a perspective view showing a connector and a flexible board of Patent Document 1, wherein the flexible board is not yet connected to the connector.
Figure 19:
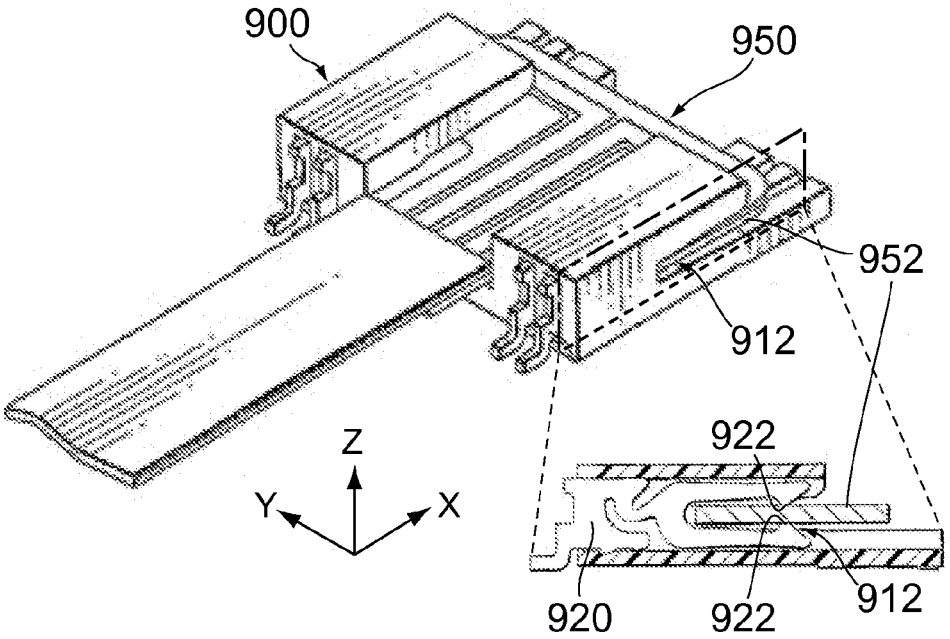
FIG.19 PRIOR ART
FIG. 19 is a combination of a perspective view and a cross-sectional view each showing the connector and the flexible board of FIG. 18, wherein the flexible board is connected to the connector.

As shown in FIGS. 1 and 17, the most part of the contact 300 is placed within the accommodation ditch 230 or within the receive portion 270. In detail, the held portion 320 of the contact 300 is press-fit into the accommodation ditch 230 from behind to be held in the accommodation ditch 230. However, the contact 300 may be differently attached to the housing 200, provided that the held portion 320 is securely held by the housing 200.

The first contact portion 342 and the second contact portion 352 of the contact 300, which is press-fit in the accommodation ditch 230, are located in the receive portion 270. In detail, the first spring portion 340 extends in the receive portion 270 to locate the first contact portion 342 within the receive portion 270. The second spring portion 350 extends in the accommodation ditch 230 to make the second contact portion 352 project from the accommodation ditch 230 into the receive portion 270.

As shown in FIG. 1, the fixed portions 310 of the contacts 300 project to the outside of the housing 200 from the rear end 204 of the housing 200. When the connector 10 is used, the fixed portions 310 are connected and fixed to conductive patterns (not shown) of the circuit board 80 by soldering or the like.

Figure 8:
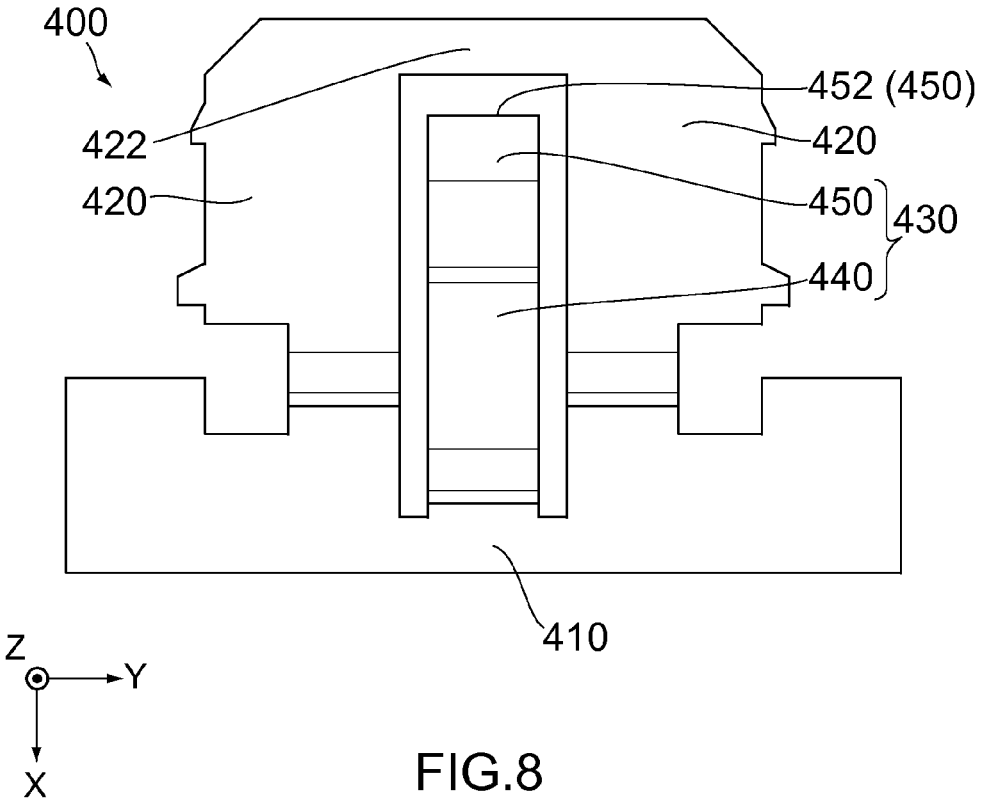
FIG. 8 is a top view showing a regulating member of the connector of FIG. 1.
Figure 9:
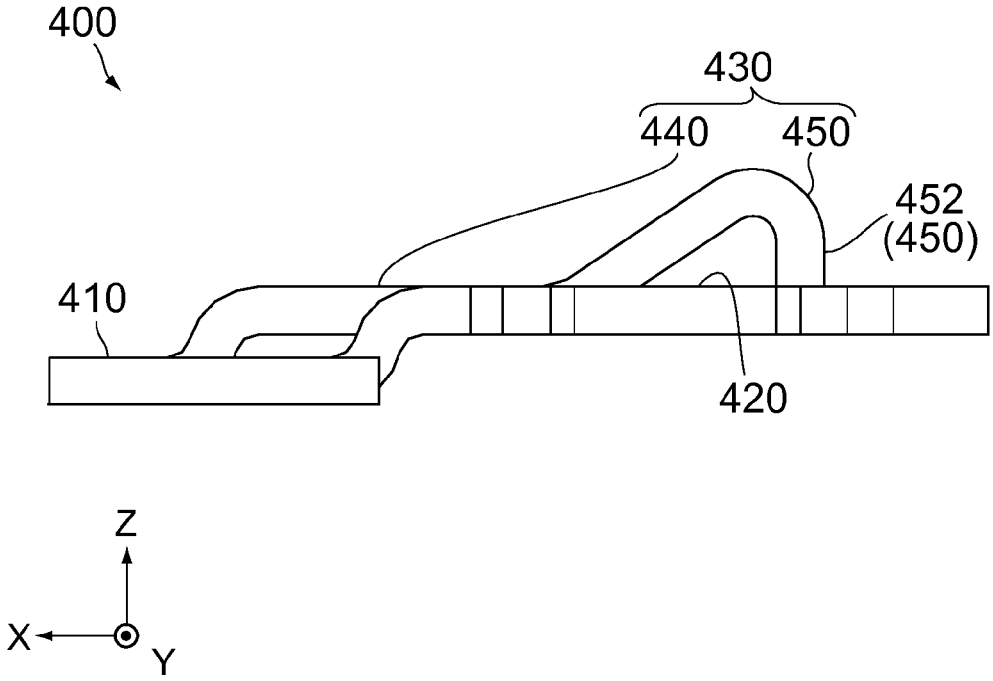
FIG. 9 is a side view showing the regulating member of FIG. 8.

As shown in FIGS. 8 and 9, the holddown 400 according to the present embodiment has a fixed-to-board portion 410, two fixed portions 420, a coupling portion 422, a spring portion 440 and a regulating portion 450. The spring portion 440 and the regulating portion 450 constitute a regulating member 430. In other words, the regulating member 430 has the spring portion 440 and the regulating portion 450. The regulating member 430 according to the present embodiment is a part of the holddown 400 and is formed separately from the housing 200. However, the regulating member 430 may be a member separated from the holddown 400.

The fixed-to-board portion 410 has a flat plate-like shape which extends long in the Y-direction while extending short in the X-direction. The fixed portions 420 extend rearward (in the negative X-direction) from the fixed-to-board portion 410. Each of the fixed portions 420 is formed with press-fit protrusions. The coupling portion 422 couples end portions of the two fixed portions 420 in the Y-direction.

The regulating member 430 is provided at a middle part of the holddown 400 in the Y-direction. In detail, the spring portion 440 is located between the two fixed portions 420 in the Y-direction. The spring portion 440 is resiliently deformable. The regulating portion 450 is supported by the spring portion 440 and is movable vertically, or in the Z-direction. When the regulating portion 450 receives no force except its own weight, or when the spring portion 440 is not resiliently deformed, the regulating portion 450 is located at an initial position (the position shown in FIG. 9).

When the regulating portion 450 is located at the initial position, the spring portion 440 extends rearward from the fixed-to-board portion 410 while sloping upward and subsequently extending long rearward. The spring portion 440 has an end portion which further extends rearward while sloping upward. The regulating portion 450 in the initial position extends downward from the spring portion 440. The regulating portion 450 according to the present embodiment has a rear surface 452. When the regulating portion 450 is located at the initial position, the rear surface 452 is perpendicular to the X-direction.

As can be seen from FIGS. 1 and 3, the fixed portions 420 are press-fit into the fixing grooves 220 of the housing 200 from front thereof, respectively. Accordingly, the regulating member 430 according to the present embodiment is indirectly fixed to the housing 200 by the fixed portions 420 of the holddown 400. However, the regulating member 430 may be differently fixed to the housing 200. For example, when the regulating member 430 is formed separately from the holddown 400, the regulating member 430 may be directly fixed to the housing 200.

As can be seen from FIG. 1, when the connector 10 is used, the fixed-to-board portion 410 is fixed to the circuit board 80 by soldering or the like so that the housing 200 is fixed to the circuit board 80. In other words, the fixed-to-board portion 410 is necessary to fix the housing 200 to the circuit board 80 regardless of whether the regulating member 430 is provided or not. In addition, the regulating member 430 according to the present embodiment is a part of this fixed-to-board portion 410. Accordingly, even when the regulating member 430 is provided, the connector 10 does not increase in size in the X-direction. Moreover, even if the regulating member 430 is formed separately from the holddown 400, the connector 10 does not increase in size in the X-direction, provided that the regulating member 430 is fixed to the front end 202 of the housing 200 similar to the holddown 400.

Hereafter, explanation is made mainly about an operation which is performed when the FPC 60 (see FIG. 10) is connected to the connector 10 (see FIG. 1) having the aforementioned structure.

Figure 13:
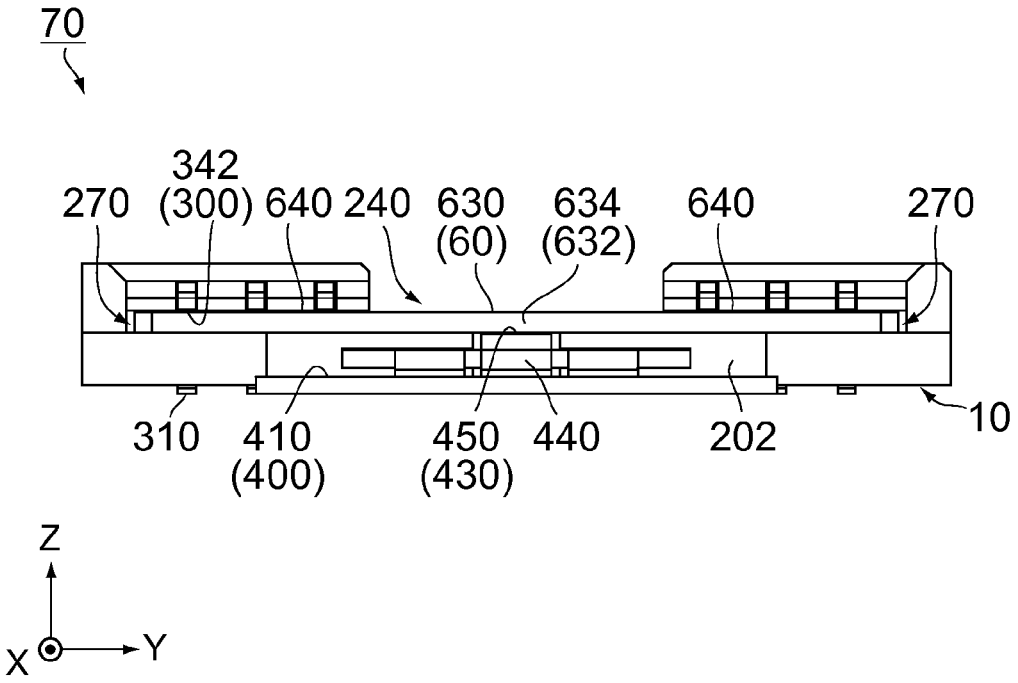
FIG. 13 is a front view showing the connector assembly of FIG. 12.

As shown in FIGS. 11 to 13, prior to connecting the FPC 60 to the connector 10, the FPC 60 is firstly placed on the upper surface 212 of the housing 200. In detail, the guided portion 620 of the FPC 60 is inserted into the guide portion 240 of the housing 200 from above so that the received portions 640 are located in front of the receive portions 270, respectively. In the meantime, the regulating portion 450 of the regulating member 430 is pressed by the FPC 60 to be moved downward from the initial position (see FIG. 1). When the regulating portion 450 is moved downward, the regulating portion 450 receives an upward restoring force from the resiliently deformed spring portion 440 to be pressed against a lower surface (negative Z-side surface) of the FPC 60.

Then, as shown in FIGS. 12 and 14, when the guided portion 620 is moved rearward along the guide portion 240 under the state where the regulating portion 450 is moved downward, the received portions 640 are inserted into the receive portions 270, respectively. When the guided portion 620 is further moved rearward, the received portions 640 are brought into abutment with the rear walls 262 (see FIG. 17), and the connector 10 is connected to the FPC 60.

Referring to FIGS. 14 and 15, the width W1 of the guide portion 240 according to the present embodiment is nearly equal to the width W2 of the guided portion 620. Accordingly, during the connecting process of the FPC 60 to the connector 10, the received portions 640 are properly guided toward the receive portions 270, respectively. Moreover, in the meantime, the guided portion 620 slides on the upper surface 212 of the housing 200. Accordingly, the received portions 640 can be smoothly guided toward the receive portions 270, respectively. However, the guided portion 620 may be moved while being slightly distant from the upper surface 212 to be located over the upper surface 212.

As shown in FIGS. 14, 15 and 17, under the connected state where the connector 10 is connected to the FPC 60, the receive portions 270 receive the received portions 640, respectively. Under the connected state, the most part of the received portion 640 is inserted within the corresponding receive portion 270. In particular, a rear end (negative X-side end) of the received portion 640 is inserted between the first contact portions 342 and the second contact portions 352 of the contacts 300. As a result, the received portion 640 applies an upward force to the first contact portions 342 to move the first contact portions 342 upward while applying a downward force to the second contact portions 352 to move the second contact portions 352 downward. In the meantime, the second contact portions 352 of the contacts 300 are brought into contact with the contact terminals 662 of the received portion 640, respectively.

Figure 16:
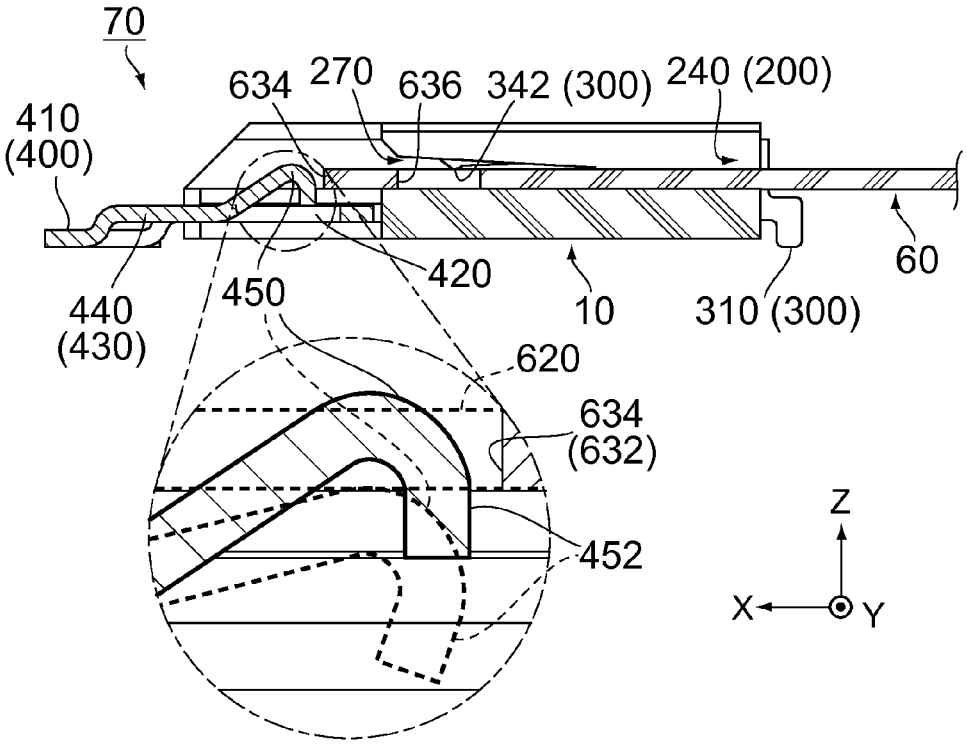
FIG. 16 is a cross-sectional view showing the connector assembly of FIG. 15, taken along line XVI-XVI, wherein the vicinity of a regulating portion of the regulating member (the part encircled by chain dotted line) is enlarged to be illustrated, and an outline of the FPC and an outline of the regulating portion prior to the connection of the connector to the FPC are illustrated by dashed line in the enlarged view.

As shown in FIGS. 14 to 16, under the connected state, the regulating portion 450 returns to the initial position by the restoring force of the spring portion 440. When the regulating portion 450 returns to the initial position, a click feeling can be obtained. By this click feeling, an operator of the FPC 60 can easily know that the connector 10 is properly connected to the FPC 60.

Moreover, according to the present embodiment, when the regulating portion 450 returns to the initial position, the rear surface 452 of the regulating portion 450 extends vertically. Accordingly, it is easily visible from above that the rear surface 452 is slightly distant from and is located in front of the front end 632 of the FPC 60. According to the present embodiment, also by visually recognizing positions of the rear surface 452 and the front end 632 in the X-direction, it can be easily known that the connector 10 is properly connected to the FPC 60.

Referring to FIG. 17, under the connected state, the first contact portion 342 and the second contact portion 352 of each of the contacts 300 sandwich the received portion 640 vertically, or in the Z-direction. In other words, the received portion 640 is pushed downward by a spring force (holding force) of the first contact portion 342 while being pushed upward by another spring force (holding force) of the second contact portion 352. In particular, in the present embodiment, because the first contact portion 342 and the second contact portion 352 are located at positions same as each other in the X-direction, each of the received portions 640 is securely held by the holding forces due to the three contacts 300.

Moreover, referring to FIGS. 6 and 15, the width W1 of the guide portion 240, or the distance between the two rear walls 262, is nearly equal to the width W2 of the guided portion 620. Accordingly, the FPC 60 under the connected state is securely kept at a proper position in the Y-direction. For example, if the connector 10 receives impact, the FPC 60 is hardly moved in the Y-direction.

Moreover, referring to FIG. 16, under the connected state, the regulating portion 450 returns to the initial position and is located forward of the regulated portion 634 to regulate a forward movement of the regulated portion 634. For example, even if the connector 10 receives impact to move the received portion 640 forward, the regulated portion 634 is brought into abutment with the regulating portion 450 so that the received portion 640 is prevented from coming off the receive portion 270. In other words, the connected state is maintained. In particular, according to the present embodiment, under the connected state, the vertically extending rear surface 452 is located in front of the regulated portion 634. Accordingly, the forward movement of the regulated portion 634 is regulated more securely.

As can be seen from FIG. 14, the FPC 60 in the connected state can be detached from the connector 10 by pushing and moving the regulating portion 450 downward. In particular, according to the present embodiment, the FPC 60 can be easily detached by using the release hole 636 of the FPC 60. For example, the FPC 60 can be detached by inserting a jig (not shown) into the release hole 636, and subsequently, strongly pulling the front end portion 630 upward and forward. In other words, under the connected state, the regulated portion 634 can be released from the regulating portion 450 by operating the FPC 60 with use of the release hole 636.

The connector assembly 70 (see FIG. 14) according to the present embodiment can be variously modified in addition to the modifications which are already explained.

For example, referring to FIG. 1, the regulating member 430 of the connector 10 may be formed integrally with the housing 200, provided that the spring portion 440 has a sufficient spring force and the regulating portion 450 has a sufficient regulating force. For example, the regulating member 430 may be formed integrally with the housing 200 via insert-molding or may be a part of the housing 200.

Referring to FIG. 14, the connector 10 may comprise a plurality of the regulating members 430. For example, the two regulating members 430 may be located in front of the receive portions 270, respectively. In this case, two parts of the front end 632 of the FPC 60 function as the regulated portions 634.

Referring to FIG. 1, the connector 10 may comprise more contacts 300. In this case, the connector 10 is connectable to the FPC 60 which is formed with more contact terminals 662 (see FIG. 10). As the number of the contacts 300 increases, the holding force due to the contacts 300 under the connected state becomes larger. Accordingly, the connected state can be maintained more securely. However, as can be seen from FIG. 10, in the present embodiment, the width of the FPC 60 becomes larger in proportion to about twice of the number of the contact terminals 662 so that the width of the connector 10 (see FIG. 1) also becomes larger. From a view point of reducing a space where the connector 10 is installed, the number of the contact terminals 662 of the FPC 60 is preferred to be small.

Referring to FIG. 10, the FPC 60 may have a shape different from that of the present embodiment. For example, the guided portion 620 and the front end portion 630 of the FPC 60 may have an L-like shape as a whole. In other words, the FPC 60 may include only one received portion 640. In this case, the connector 10 (see FIG. 1) may comprise only one receive portion 270. However, from a view point of stably maintaining the connected state (see FIG. 14), the received portions 640 are preferred to be provided at opposite sides of the FPC 60, respectively.

Referring to FIG. 10, the release hole 636 does not need to be located at the front end portion 630. For example, the release hole 636 may be provided at the guided portion 620. For another example, the position of the release hole 636 in the Y-direction may be shifted from the middle part of the front end portion 630. Moreover, the FPC 60 does not necessarily need to have the release hole 636. However, from a view point of easy operation of the FPC 60 by the use of the release hole 636 without making the width of the FPC 60 large, the release hole 636 is preferred to be formed similar to the present embodiment.

Referring to FIG. 10, the regulated portion 634 does not need to be located at the position same as that of the front end 632. For example, the middle part of the front end 632 in the Y-direction may be recessed rearward. In this case, the regulated portion 634 is located rearward of the front end 632. Moreover, the release hole 636 may be formed so as to receive the regulating portion 450 (see FIG. 14) which is inserted thereinto under the connected state. In this case, an edge surface of the release hole 636 functions as the regulated portion 634. However, as can be seen from FIG. 15, in order for the regulating portion 450 to be inserted into the release hole 636 under the connected state, the position of the release hole 636 needs to be shifted forward. In other words, the front end portion 630 needs to be made longer in the X-direction in order only to provide the release hole 636. Accordingly, the regulated portion 634 is preferred to be provided similar to the present embodiment unless a special requirement.

Referring to FIG. 10, the conductive patterns 660 may be exposed not on the rear surface but on the front surface of the FPC 60. In this case, as can be seen from FIG. 17, not the second contact portion 352 but the first contact portion 342 of the contact 300 is brought into contact with the contact terminal 662 under the connected state. As can be seen from the above explanation, the connector 10 according to the present embodiment is connectable to the FPC 60 regardless of whether the conductive patterns 660 are formed on any surface of the FPC 60. Moreover, the connector 10 according to the present embodiment is connectable to the FPC 60 even when the conductive patterns 660 are formed on both surfaces of the FPC 60.

The present application is based on a Japanese patent application of JP2014-035238 filed before the Japan Patent Office on Feb. 26, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector connectable to an object, the object comprising a regulated portion, a guided portion extending along a front-rear direction and a front end portion located forward of the guided portion, the front end portion having a received portion protruding sideward beyond the guided portion, the received portion being formed with a contact terminal, wherein:

the connector comprises a housing, a contact and a regulating member;

the housing has a guide portion and a receive portion;

the guide portion extends along the front-rear direction;

the receive portion is located at a side of the guide portion and opens forward;

the contact has a held portion and a contact portion;

the held portion is held by the housing;

the contact portion is located in the receive portion;

the regulating member has a spring portion and a regulating portion;

the regulating member is fixed to the housing;

the regulating portion is supported by the spring portion and is vertically movable;

when the guided portion is moved rearward along the guide portion under a state where the regulating portion is pressed by the object to be moved downward from an initial position, the connector is connected to the object;

under a connected state where the connector is connected to the object, the receive portion receives the received portion, and the contact portion is brought into contact with the contact terminal; and under the connected state, the regulating portion returns to the initial position and is located forward of the regulated portion to regulate a forward movement of the regulated portion.

2. The connector as recited in claim 1, wherein the regulation member is formed separately from the housing.

3. The connector as recited in claim 1, wherein:
the connector comprises a holddown;
the regulation member is a part of the holddown; and
the holddown has a fixed-to-board portion which is to be fixed to a circuit board.

4. The connector as recited in claim 1, wherein the regulation member is a part of the housing.

5. The connector as recited in claim 1, wherein the regulation member is fixed to a front end of the housing.

6. The connector as recited in claim 1, wherein:
the regulating portion has a rear surface which is perpendicular to the front-rear direction; and
the rear surface is located in front of the regulated portion under the connected state.

7. The connector as recited in claim 1, wherein:
the contact portion of the contact is formed of a first contact portion and a second contact portion; and
under the connected state, the first contact portion and the second contact portion vertically sandwich the received portion.

8. A connector assembly comprising the connector as recited in claim 1 and a flexible printed circuit (FPC) which is one kind of the object, wherein the regulated portion is a part of a front end of the front end portion.

9. The connector assembly as recited in claim 8, wherein:
the FPC comprises the two received portions;
the connector comprises the two receive portions;
the received portions are located at opposite sides of the front end portion, respectively; and
the receive portions are located at opposite sides of the housing, respectively, while putting the guide portion therebetween.

10. The connector assembly as recited in claim 8, wherein:
the front end portion is formed with a release hole;
the release hole vertically pierces the front end portion; and
under the connected state, the regulated portion is releasable from the regulating portion by operating the FPC with use of the release hole.

* * * * *